US005251550A

United States Patent [19]

Grössler et al.

[11] Patent Number: 5,251,550

[45] Date of Patent: Oct. 12, 1993

[54] APPARATUS WITH RAPID MAGNETIC FIELD COMPRESSION

[75] Inventors: Peter Grössler, Hochstadt; Norbert Nissl, Aresing, both of Fed. Rep. of Germany

[73] Assignee: Messerschmitt-Bölkow-Blohm GmbH, Munich, Fed. Rep. of Germany

[21] Appl. No.: 900,986

[22] Filed: Aug. 7, 1986

[30] Foreign Application Priority Data

Aug. 7, 1985 [DE] Fed. Rep. of Germany ..... 3528338

[51] Int. Cl.[5] ..... F42B 12/02

[52] U.S. Cl. ..... 102/293; 89/1.11

[58] Field of Search ..... 102/200, 206, 293, 374, 102/473, 476, 491, 494, 501, 517; 89/1.11, 8

[56] References Cited

U.S. PATENT DOCUMENTS 4,334,474 6/1982 Coltharp ..... 102/206

*Primary Examiner*—Charles T. Jordan

*Attorney, Agent, or Firm*—Anderson, Kill, Olick & Oshinsky

[57] ABSTRACT

The invention is directed to apparatus whose weapon efficiency is effected in cooperation via a highly compressed magnetic field, wherein the base magnetic field is maintained or increased beforehand by magnetohydrodynamic generator stages which are operated by propelling charges and/or explosives.

9 Claims, 4 Drawing Sheets

APPARATUS WITH RAPID MAGNETIC FIELD COMPRESSION

The invention is directed to an apparatus whose weapon efficiency is effected in cooperation by means of a highly compressed magnetic field.

Missiles containing either an electromagnetically accelerated P-charge or a correspondingly working apparatus for producing a weapon EMP effect—that is, an electromagnetic pulse for damaging electronic devices—are known per se. The problem in these known systems is the production of the necessary primary energy for producing the base magnetic field, which must be present prior to the actual magnetic field compression.

The invention has the object of providing the necessary electric primary energy for producing the base magnetic field in an apparatus of the type named in the beginning, without great expenditure.

The object is met by means of the steps shown in the main claim. Advantageous constructions are given in the subclaims. Embodiment examples are explained in the specification and shown in the drawing.

In order to solve the problem in question, the general inventive idea provides the use of magnetohydrodynamic generators (MHD generators) within the apparatus, which magnetohydrodynamic generators are operated by propelling charges and/or explosives and are constructed as missiles in the embodiment examples described in the following. It has been shown that the magnetic field necessary for this purpose for the beginning can be smaller by an order of magnitude than is necessary for the beginning of a detonating compression distance. The magnetic field can be produced without great difficulty in the MHD booster by means of a special apparatus in the launcher via current contacts before the ignition of the MHD booster The current contacts can be constructed as so-called tear-off contacts.

Figure 1:
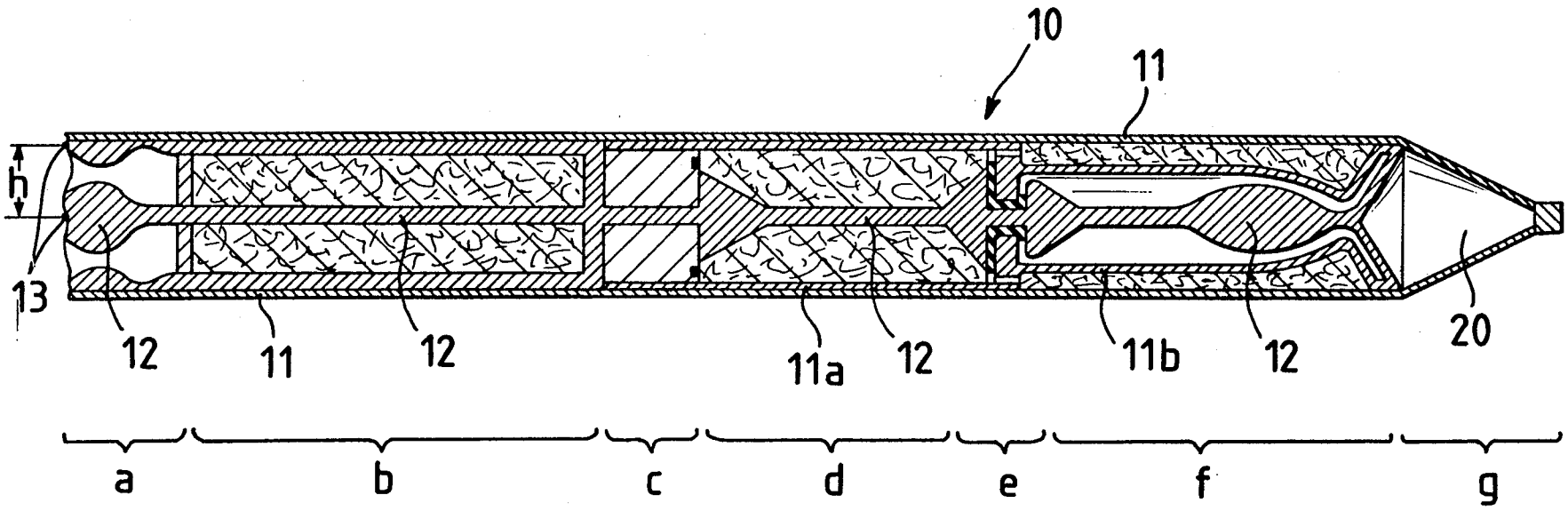
FIG. 1 shows a basic sketch for an anti-tank missile in longitudinal section.

FIG. 1 shows an embodiment example of a basic construction, specifically for a so-called anti-tank missile Before ignition of the MHD booster "b", a primary current is fed via sliding contacts or tear-off contacts 13 into the coaxially constructed MHD booster "b" via the ring nozzle "a" This current flows via the inner conductor of the ring nozzle "a", the propelling charge-operated MHD generator stage "b" (MHD booster), the igniter "c", the detonation-operated MHD generator stage "d", the transition part "e" and the compression and acceleration part with packing "f" and is led back in the latter to the outer conductor which is either formed by the outer casing 11 itself or consists of a copper lining 11*a* of the outer casing or is only a copper jacket 11*b* so that the current flows back again in the reverse direction until the ring nozzle "a".

This primary current produces a magnetic field whose field lines run annularly around the inner conductor 12, thus forming a magnetic field in the short circuited coaxial conductor.

After constructing this magnetic field, the first MHD stage "b"—the MHD booster—is fired, by means of which the MHD principle is brought into action, so that the primary current flowing in the coaxial arrangement is correspondingly increased.

After the missile 10 is released from the launcher and has covered a certain distance, the MHD booster is driven to maximum thrust in a stepwise manner so that the flowing MHD current finally increases to, e.g. 300 kilo-amperes, in the case shown, and is first maintained at this level.

After the ignition of the detonation-operated MHD generator stage "d" is effected, triggered by means of target proximity or target impact, an intermediate increase of the current is carried out in this stage, for example, in the case described here, to a plurality of megaamperes.

The MHD stage "d", described above, is a hybrid between an MHD stage and a magnetic field compression stage. This can also be said, in a somewhat restricted sense, of the MHD stage "b", in which the primary magnetic field is produced either by means of permanent magnets or by means of a battery, which can be activated, or by means of a capacitor charge.

Figure 2:
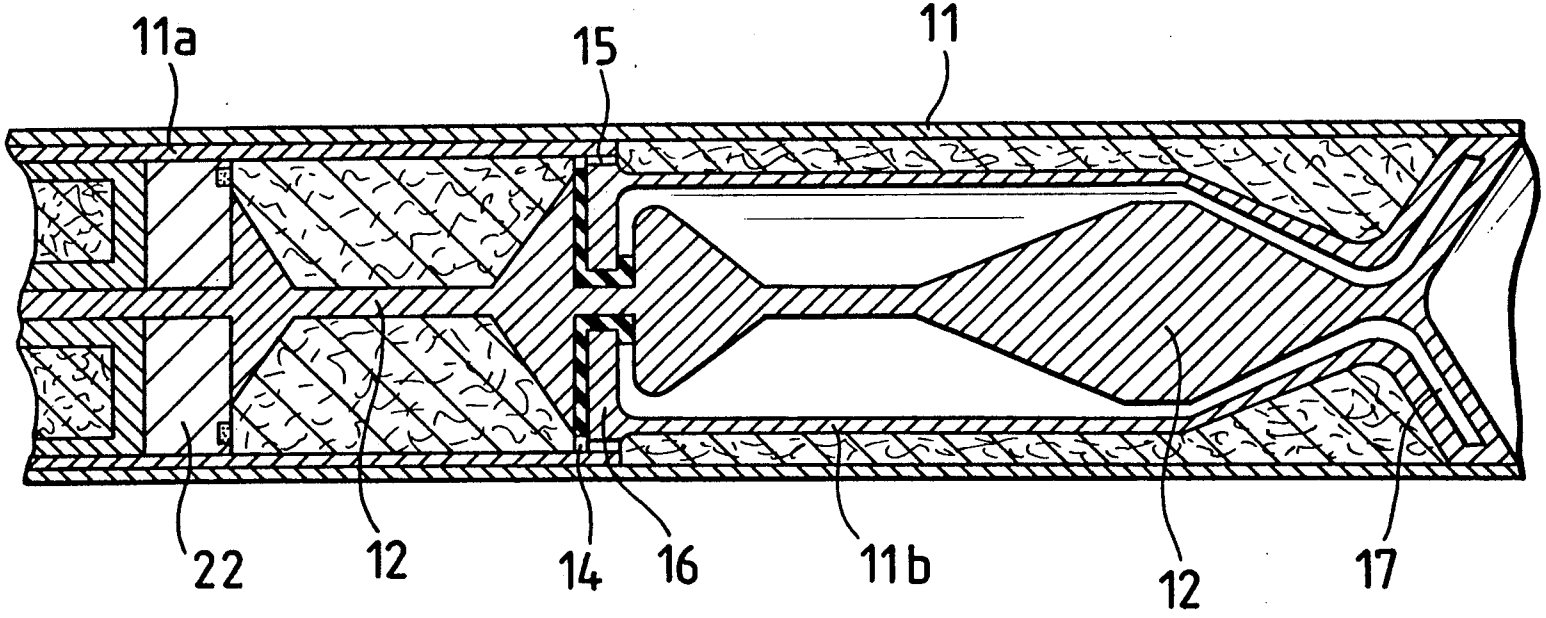
FIG. 2 shows a basic sketch for a warhead of a missile according to FIG. 1 in longitudinal section.

FIG. 2 of the drawing illustrates the continued description. As soon as the detonation front reaches the detonation transition part 14 of the MHD stage "e", the detonation is transmitted via a quantity of symmetrically arranged ignition holes through the outer conductor part 11*b*, which is constructed as transition part 16, to the concluding MHD compression or final stage "f" in which the current is finally increased in the magnitude of tens of megaamperes. The correspondingly compressed, strong magnetic field will now accelerate a P-charge—according to the missile variant—for anti-tank fighting or, in the case of the embodiment example of an anti-aircraft missile, described in the following, will tear off or destroy a short circuit conductor so that a corresponding electromagnetic pulse for aircraft fighting is radiated via the front part (with radome 19) of the coaxial system, which front part is constructed as a wide band antenna.

In addition, it is suggested that the acceleration and/or sustainer engine 17 be constructed additionally as MHD generator.

Figure 3:
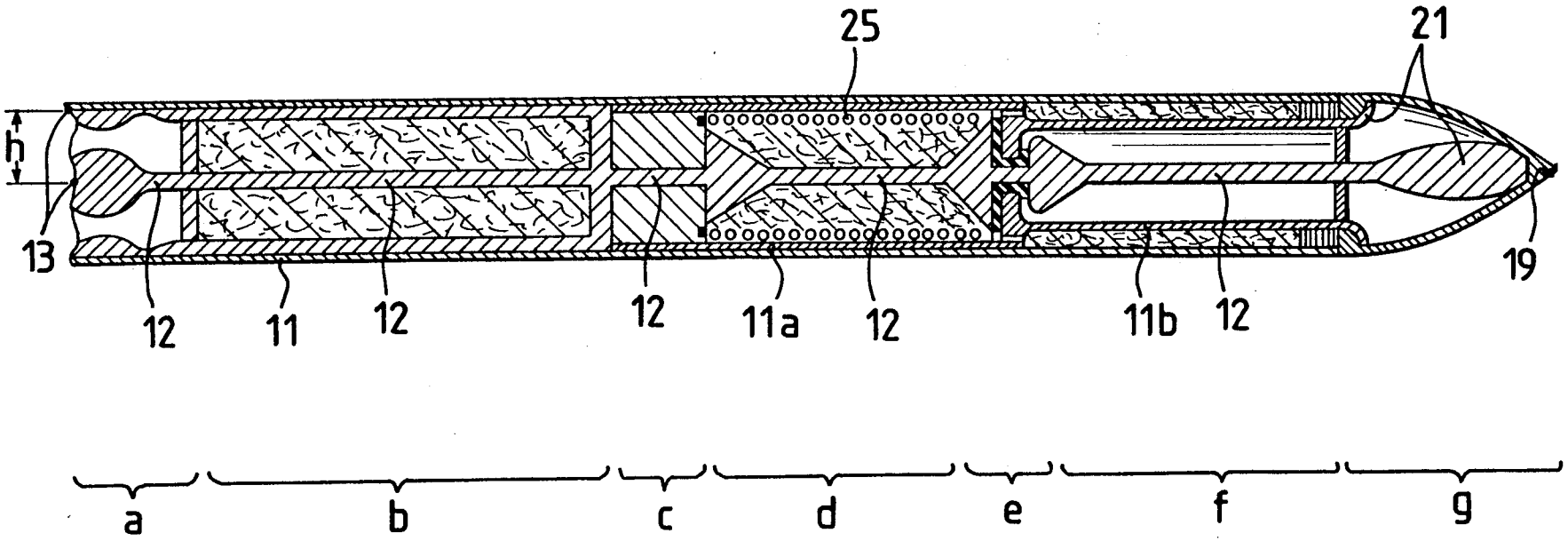
FIG. 3 shows a basic sketch of an anti-aircraft missile in longitudinal section.
Figure 4:
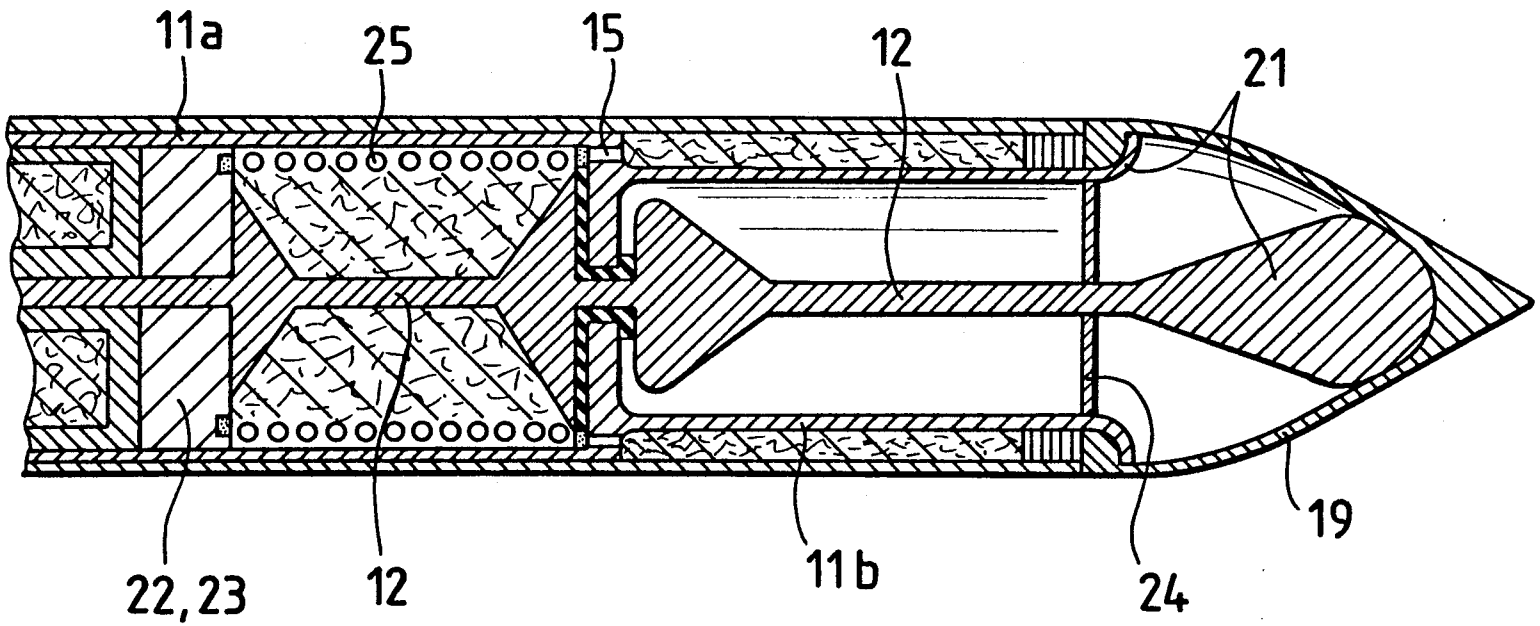
FIG. 4 shows a longitudinal section of the warhead of the missile according to FIG. 3.

As already mentioned, FIGS. 3 and 4 show another embodiment example of the invention which is directed to an anti-aircraft missile. The construction of the system is essentially identical to the embodiment example described above, only the two front missile stages "f" and "g" differ from one another. In the first example the compression stage "f" passes into a final stage "g" comprising an acceleration part with packing and is provided with an impact igniter 20, and in the second embodiment example the, compression stage "f" passes into another stage "g" with antenna part 21 and radome 19. The electromagnetic pulse for fighting aircraft is radiated around the missile axis so as to be symmetrical with respect to rotation in a conical area which is fanned out in a forward direction. The construction of this embodiment example is shown in FIG. 4, so that additional constructions beyond the latter are not necessary. The detonating compression stage "d" is additionally constructed as a splinter head, in which preformed splinters 25 are inserted or poured, in order to reinforce the weapon effect. The compression stage "f" can also be constructed in this manner. In the figures of the drawing the igniter plates are designated by 22, the approach sensor, which is not designated in more detail, carries the reference numeral 23, and the short circuit conductor at the head end of the compression stage "f" carries the reference numeral 24.

The detonating MHD compression stages "d" and "f" are triggered via a sensor system and/or timing elements, not shown, specifically at a point in time at which the MHD booster "b" is still wholly functioning. The thrust nozzle of the embodiment forms described above, through which flow the gases of the MHD booster "b", is preferably constructed as a ring nozzle "a". In addition, it is advantageous that the inner conductor 12 be supported relative to the outer conductor 11 within the coaxial MHD booster "b" by means of electrically insulating parts—such as, e.g. perforated plates etc.

We claim:

1. A missile having a weapon efficiency effected by means of a highly compressed magnetic field, comprising an axially elongated casing having a leading end and a trailing end with a plurality of stages within said casing, at lest one propelling charge-operated magnetohydrodynamic generator stage located within said casing, a stage for magnetic field compression located between said magnetohydrodynamic stage and the leading end of said casing, said magnetohydrodynamic generator stage and said magnetic field compression stage cooperating for the production of at lest one of current and amplification, and said magnetic field compression stage produces a weapon effect produced by said magnetohydrodynamic generator stage acting as a base field.

2. A missile, as set forth in claim 1, wherein a primary magnetic field for operating said magnetohydromagnetic generator stage is produced and fed into a stage at the trailing end of said casing by a current source located in a missile launcher mounting the missile before launching.

3. Apparatus as set forth in claim 1 or 2, wherein the primary magnetic field for said magnetohydrodynamic generator stage is produced by one of permanent magnets, a battery and a capacitor discharge.

4. A missile, as set forth in claim 1 or 2, wherein said missile is constructed as a MHD generator.

5. A missile, as set forth in claim 1 or 2, wherein a first and second said magnetohydrodynamic generator stages are located within said casing in spaced relationship and said magnetic field compression stage is located between said magnetohydrodynamic generator stages and the leading end of said casing, said magnetohydrodynamic generator stages and said magnetic field compression stages are electrically connected with one another.

6. A missile, as set forth in claim 5, wherein said second magnetohydrodynamic generator stage incorporates splinter heads for reinforcing the weapon effect.

7. A missile, as set forth in claim 6, wherein said second magnetohydrodynamic generator stage is triggered by at least one of a sensor system and timing element at the time of the full functioning of said first magnetohydrodynamic generator stage.

8. A missile, as set forth in claim 1 or 2, wherein said casing forms a return conductor and an inner conductor within said casing are mechanically interconnected with one another.

9. A missile, as set forth in claim 1 or 2, wherein said casing forms a return conductor and an inner conductor within said casing are electrically interconnected with one another.

* * * * *